US005893212A

United States Patent [19]

Meister

[11] Patent Number: 5,893,212

[45] Date of Patent: Apr. 13, 1999

[54] CIGAR CUTTER

[75] Inventor: Ronald J. Meister, Bradford, Pa.

[73] Assignee: Zippo Manufacturing Company, Bradford, Pa.

[21] Appl. No.: 08/921,121

[22] Filed: Aug. 29, 1997

[51] Int. Cl.[6] ..... A24F 13/26

[52] U.S. Cl. ..... 30/113; 30/279.2

[58] Field of Search ..... 30/109, 110, 111–113, 30/279.2

[56] References Cited

U.S. PATENT DOCUMENTS 232,864 10/1880 Wienhold .
715,315 12/1902 Steinecke .
835,912 11/1906 Obermayer .
855,203 5/1907 Schickerling .
1,043,363 11/1912 Schickerling .
1,086,920 2/1914 Kiefer .
1,136,182 4/1915 Swift .
3,903,598 9/1975 Lefebvre ..... 30/112
4,837,931 6/1989 Beermann ..... 30/92
5,471,198 11/1995 Newham ..... 340/573

*Primary Examiner*—Douglas D. Watts
*Attorney, Agent, or Firm*—Hodgson, Russ, Andrews, Woods & Goodyear, LLP

[57] ABSTRACT

Cigar cutters having sliding blades are disclosed. The cutters are relatively flat and are designed to fit in a pocket. The inner ends of the blades have arcuate cutting edges to aid in cutting. The outer ends of the blades have handles with apertures.

9 Claims, 2 Drawing Sheets

FIG. 1
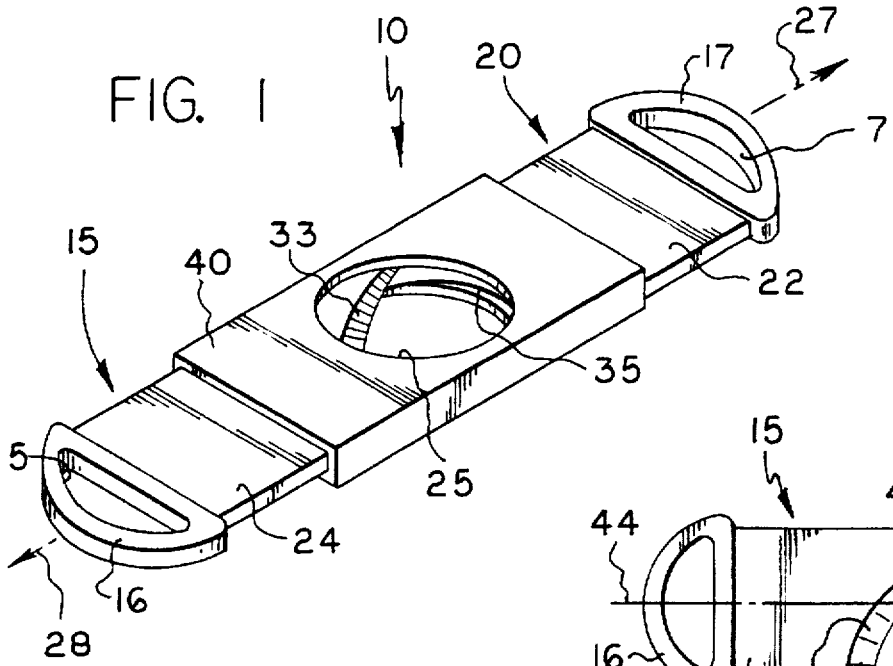
FIG. 2
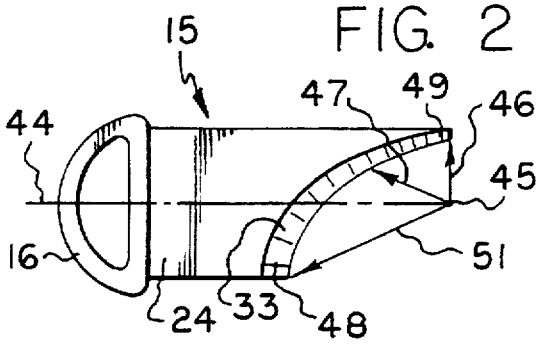
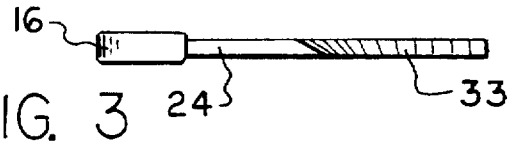
FIG. 3
FIG. 4
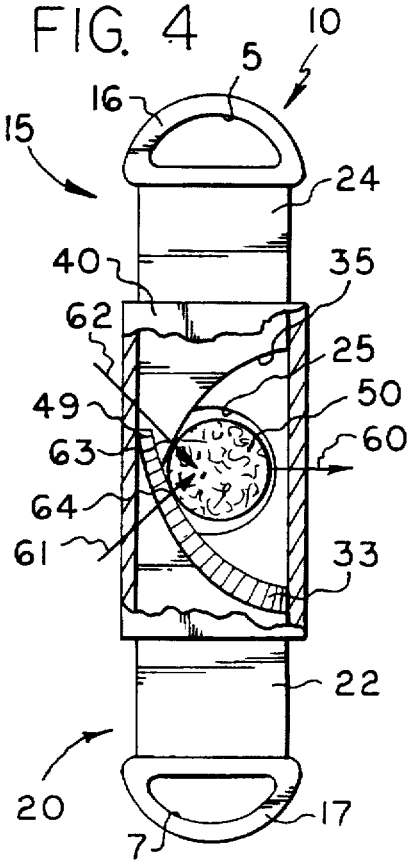
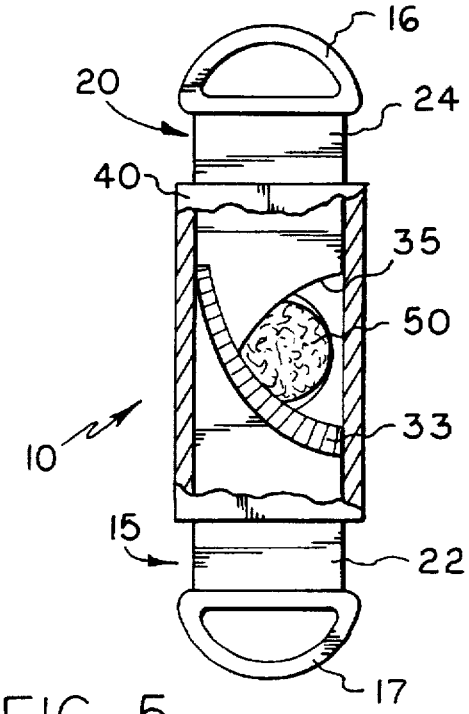
FIG. 5

CIGAR CUTTER

BACKGROUND OF THE INVENTION

1. Field of the Invention

The present invention relates generally to a cigar cutting apparatus for cutting the tip from a cigar preparatory to lighting the same, and particularly to a cigar cutter designed to slice the tip of a cigar cleanly and in a manner which prolongs blade life.

2. Prior Art

Many devices are known for cutting the end of a cigar. Most of these devices incorporate a flat steel blade or pair of blades of the same size and shape. The blades travel perpendicular to the central axis of the cigar and trim the cigar with a chopping motion. While these may be effective in severing the cigar tip from the cigar they all have a common disadvantage. That is, they tend to crush or tear the body of the cigar, or even the cigar wrapper, rather than cutting cleanly. This effect becomes even more pronounced as the blades dull.

A further limitation of the prior art devices is the chopping motion with which the blades act upon the cigar tip. That is, the blades first impact the opposing surfaces of the cigar tip at points where the distance between these surfaces is greatest. Further the opposing surfaces of the cigar tip tend to be compressed simultaneously, thereby producing an undesirable crushing effect upon the cigar.

Compounding the crushing problem encountered with the prior art devices, is the fact that the impact of the blades upon the cigar body tends to be focused on a limited area of the blades. The repeated application of cutting force to this limited area of the blades' cutting surfaces, causes the blades to dull more quickly than would be the case if the impact were distributed over an extended area of the blades' cutting surfaces, as occurs with a slicing action.

U.S. Pat. No. 715,315 to Steinecke discloses a cigar cutter comprising two flat sheet metal members provided with cooperating knife edges, or blades, each member having a digital recess by means of which it may be actuated in either direction relative to the other member. However, this device does not overcome the limitations described above in that the forces of impact of the disclosed blades with the cigar tend to be concentrated within a relatively small area of the blades' cutting surfaces. In addition the disclosed blades are configured so as to disadvantageously produce the chopping motion described above.

U.S. Pat. No. 232,864 to J. Wienhold discloses a cigar cutter having relatively semi-circular blades which are designed to pivot toward each other as pressure is applied by the fingers to the outer wings of the cutter. These blades tend to cause all opposing surfaces of the cigar tip to be compressed simultaneously thereby increasing the tendency of the device to crush the cigar. This tendency increases as the blades dull.

U.S. Pat. No. 3,903,598 to Lefebvre proposes a cigar cutter designed to overcome the crushing problem described above. The disclosed cutter comprises two pivotally connected parts, one carrying at least two movable blades which are designed to effect a simultaneous rotational blade motion. This device suffers from the disadvantage of having a relatively large number of moving parts which increases the complexity and cost of the cutter.

A need remains for a cigar cutter which is simple to operate, has few moving parts, and which slices the cigar tip cleanly in a manner that avoids tearing or crushing the cigar or the cigar wrapper. A further need remains for a cigar cutter which reduces wear and tear on a focused section of the blades, thus prolonging the usable life of the blade.

SUMMARY OF THE INVENTION

Accordingly it is an object of the present invention to provide a cigar cutter which overcomes the deficiencies noted above and which provides clean cuts, has an extended blade life while at the same time is simple in construction and easy and convenient to operate. Such a cigar cutter comprises two reciprocating members comprising handle portions, blade carrying portions, and opposing and cooperating blade portions. The blade carrying portions and the opposing and cooperating blade portions are configured to move past one another. The blade portions are characterized by a generally sickle shape. The radius of curvature of the generally sickle shaped blades is non-constant.

The generally sickle shaped blade may have a gradually diminishing grind angle from a steepest angle at the point of initial contact between the blade and a cigar, the grind angle gradually diminishing across the length of the blade.

The cigar cutter further comprises a casing within which the opposing and cooperating cutting members are slidably mounted for movement relative to each other. The casing may include an opening for removably inserting retaining means therethrough. The blade carrying portions may include recessed portions defining a slot along each side of the blade carrying portions, the slots forming opposing and cooperating stopping edges on the distal ends of the blade portions. The slots are positioned for slidable motion relative to the retaining means, such that the outward movement of the blade carrying portions is stopped when the opposing and cooperating stopping edges engage the retaining means.

Still other objects and advantages of the present invention will become readily apparent to those skilled in this art from the following detailed description, wherein a preferred embodiment is shown and described, simply by way of illustration of the best mode contemplated by the inventor for carrying out the invention. As will be realized, the invention is capable of other and different embodiments, and its several details are capable of modifications in various obvious respects, all without departing from the invention. Accordingly, the drawings and description are to be regarded as illustrative in nature and not as restrictive.

BRIEF DESCRIPTION OF THE DRAWINGS

For a further understanding of the invention, as well as its characterizing features, reference should now be made to the accompanying drawings wherein:

FIG. 1 is a perspective view of the cigar cutter of the present invention.

FIG. 2 is a top plan view of one of the reciprocating members of the cigar cutter of the present invention.

FIG. 3 is a side elevation view of the reciprocating member of the cigar cutter of the present invention shown in FIG. 2.

FIG. 4 is a top plan view of the cigar cutter of the present invention as it appears in operation with the blade portions making initial contact with a cigar tip.

FIG. 5 is a top plan view of the cigar cutter of the present invention as it appears in operation with the blade members further contacting the cigar tip.

DETAILED DESCRIPTION OF THE INVENTION

Figure 6:
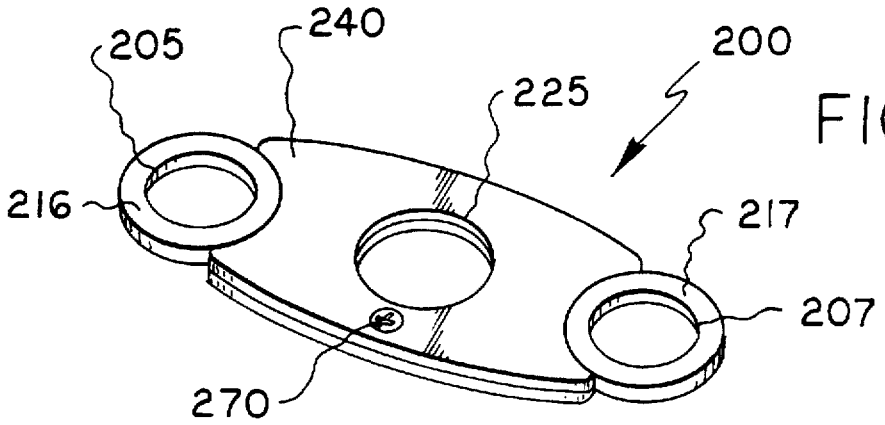
FIG. 6 is a perspective view of an alternative embodiment of a cigar cutter according to the present invention.

FIG. 1 shows a perspective view of a cigar cutter 10 according to the present invention as it appears ready to receive and cut the ends of a cigar. Cigar cutter 10 includes two generally flat reciprocating members 15 and 20 which, in a preferred embodiment are identical in form with one another. Reciprocating members 15 and 20 comprise blade carrying portions 24 and 22 and blade portions 33 and 35. Reciprocating members 15 and 20 are arranged within casing 40 for opposing and cooperating movement relative to each other. Reciprocating members 15 and 20 may further comprise handle portions 16 and 17 having apertures 5 and 7 for inserting a thumb or a finger therethrough.

Opposing and cooperating blade portions 33 and 35, and blade carrying portions 22 and 24 move past one another as the cutter is operated. The preferred embodiment shown in the drawing figures comprises two blade members 33 and 35. However, other possible configurations and arrangements, including an arrangement whereby reciprocating members 15 and 20 each carry dual blade members, may be utilized while remaining within the scope of the present invention.

Reciprocating members 15 and 20 are preferably formed from sheet metal, but may be formed of any suitable material and superposed one upon the other and secured together within casing 40. Reciprocating members 15 and 20 are slidably disposed within a casing 40 such that each reciprocating member is capable of motion in an outwardly direction. An outwardly direction is understood herein to be in the direction which tends to move blade portions 33 and 35 away from and out of casing 40, i.e., in the direction of arrow 27 for reciprocating member 20 and in the direction of arrow 28 for reciprocating member 15. Casing 40 is adapted to include a generally circular opening 25 for passing the end of a cigar therethrough.

Figure 7:
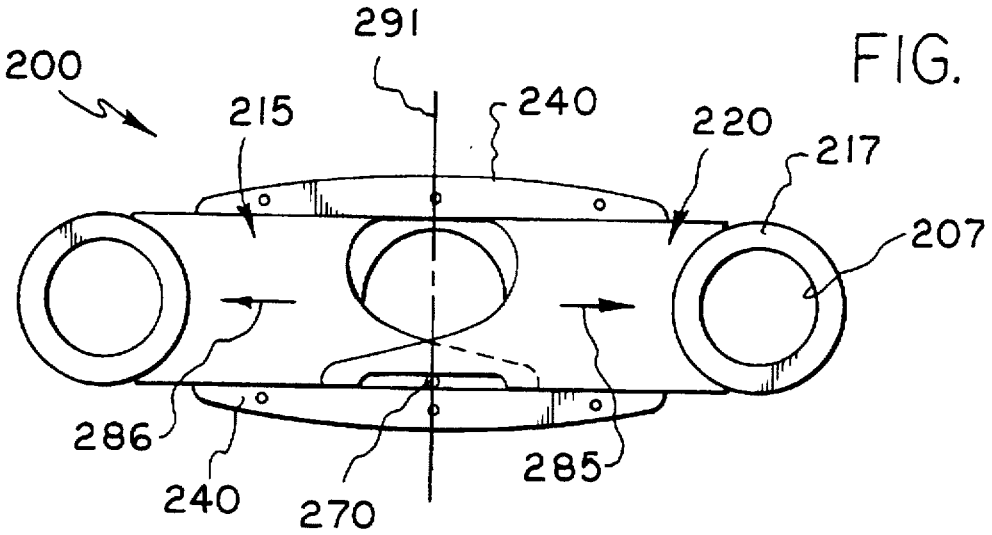
FIG. 7 is a top plan view of an alternative embodiment of a cigar cutter according to the present invention.
Figure 8:
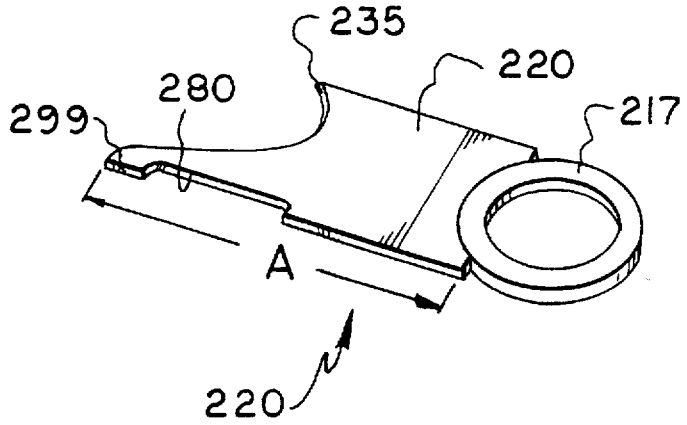
FIG. 8 is a perspective view of an alternative design for a reciprocating member of a cigar cutter according to the present invention.

In order to limit the outward movement of the reciprocating members of the cutters and to prevent disengagement of the reciprocating members from casing 40, reciprocating members 15 and 20, and casing 40 may be provided with mechanical means for limiting motion in the outwardly direction of reciprocating members 15 and 20 and for guiding them in their travel. Such limiting means may include projecting lugs (not shown) which overlie the side edges of reciprocating members 15 and 20 such that lugs engage each other when reciprocating members 15 and 20 are fully outwardly extended. Another means for limiting the outward motion of reciprocating members 15 and 20 is illustrated in FIGS. 6, 7 and 8.

Other mechanical means of limiting the outward motion of reciprocating members 15 and 20, and for securing reciprocating members in a closed position within casing 40 are known in the art and need not be elaborated upon herein.

FIG. 2 is a top plan view of reciprocating member 15. As previously stated, reciprocating members 15 and 20 are preferably substantially identical to one another and placed back to back within casing 40. That is, end 49 of blade portion 33 is placed adjacent to the corresponding end of blade portion 35 as shown in FIG. 4.

A significant feature of the present invention is the design of blade portions 33 and 35 of reciprocating members 15 and 20. As opposed to being semicircular in shape blade portions 33 and 35 have a generally sickle shape. That is, they are characterized by a non-constant radius of curvature, as best illustrated in FIG. 2.

If an imaginary pivot point such as 45 is selected to lie along the central longitudinal axis 44 of reciprocating member 15, and radial elements such as 46, 47 and 51 are extended from pivot point 45 to blade portion 33, it will be seen that the radial elements 46, 47 and 51 have gradually diminishing lengths as they are positioned over the length of blade portion 33 in a clockwise direction. In other words, their lengths are non-constant over the length of blade portion 33. Furthermore, the change in the lengths of the radial elements define a curvature for blade portion 33 which has a generally sickle shape.

Blade portions 33 and 35 are preferably, but need not be, characterized by a gradually increasing blade pitch, or steepness over the length of blade portion 33, as illustrated in FIG. 2. The pitch of blade portion 33 is shallower at end 48 as can be seen from the relatively greater width of blade portion 33 at end 48 compared to the width at end 49. The pitch of blade portion 33 gradually grows steeper toward end 49, where the pitch is greatest. The term pitch is used to refer to the steepness of the cutting edge, and is effected by varying the angle at which the edge is ground during manufacture. Accordingly, the term pitch is used synonymously herein with the term grind angle. Various manufacturing techniques for accomplishing a gradually increasing or diminishing pitch, or steepness, are known in the art and may be applied to produce blade portions 33 and 35 of the present invention.

The sickle shape of blade portions 33 and 35 produces an advantageous slicing motion when blade portions 33 and 35 are brought into contact with the side of cigar 50. As illustrated in FIG. 4, both blade portions 33 and 35 simultaneously contact the same side of cigar 50 (generally at points 63 and 64) as reciprocating members 15 and 20 operate to cut the tip of cigar 50. In the view shown in FIG. 4 the left side of cigar 50 is contacted by both blade portions 33 and 35 as they begin to cut cigar 50. The forces imparted by blade portions 33 and 35 to cigar 50 as the tip is cut, tend to move cigar 50 to the right, i.e., in the direction of arrow 60. This motion is directed against and opposed by, casing 40 as cigar 50 is moved within opening 25 in the direction of arrow 60 against casing 40.

Therefore the cutting forces of blade portions 33 and 35 upon cigar 50 will be exerted in the direction shown by arrows 61 and 62. Due to the sickle shape of blade portions 33 and 35, forces 61 and 62 tend to act at generally right angles to each other and tend to produce motion of cigar 50 in the general direction shown by arrow 60. The motion of cigar 50 in the direction of arrow 60 is opposed and limited by casing 40. In this manner casing 40, rather than an opposing blade, absorbs a portion of the initial cutting forces. As blade portions 33 and 35 are advanced toward each other a transverse (in the direction of lines 61 and 62) slicing effect of blade portions 33 and 35 upon cigar 50 is produced.

In use, the operation of cigar cutter 10 is as follows. When it is desired to carry the cigar cutter in the pocket or purse, the fingers or thumb of an operator are inserted around or through apertures 5 and 7 of handle means 16 and 17.

Reciprocating members 15 and 20 are then pushed toward one another causing blade portion 33 to slide over blade portion 35, while blade portion 35 slides beneath blade portion 33, until handle means 16 and 17 are brought into contact with casing 40. In this position blade portions 33 and 35 lie completely within casing 40. Mechanical engaging means of a type well known in the art may be used to hold reciprocating members 15 and 20 securely in position within casing 40 while cutter 10 is carried in a pocket or purse.

When it is desired to cut the end of a cigar, the operator moves reciprocating members 15 and 20 into the relative position indicated in FIGS. 1 and 4, that is extended outwardly from casing 40. Mechanical means as are well known in the art may be used to limit the outward motion of reciprocating members 15 and 20 so that blade portions 33 and 35 are prevented from escaping from casing 40.

As best illustrated in FIG. 4, the end of a cigar 50 is then inserted through opening 25 of casing 40 and between blade portions 33 and 35. The operator may then insert his thumb and one finger through apertures 5 and 7 and proceed to squeeze blade portions 33 and 35 toward one another thus clipping the end of cigar 50.

FIG. 5 illustrates the relative position of reciprocating members 15 and 20 and blade portions 33 and 35 as they are brought into closer contact with cigar 50. As can be appreciated from the drawing, the sickle shape of blade portions 33 and 35 continues to produce a transverse slicing motion as opposed to a blunt crushing motion upon cigar 50.

FIG. 6 shows an alternative embodiment 200 of a cigar cutter according to the present invention. Cigar cutter 200 is constructed such that reciprocating members 220 and 215 are limited in their travel in the outward direction, that is in the direction shown by arrows 285 and 286 in FIG. 7, by retaining means 270. Retaining means 270 is preferably a small screw which is insertable through case 240 through a small threaded opening in case 240. The placement of retaining means 270 is preferably along center line 291, and to one side of opening 225.

To accommodate retaining means 270, reciprocating members 220 and 215 are adapted to include a recessed portion defining an elongated notch or slot such as that shown at 280 in FIG. 8. Elongated notch 280 is provided along one side of reciprocating member 220. Preferably, elongated notch 280 is located along the longest side, side A, of reciprocating member 220 as shown in FIG. 8. Likewise, reciprocating member 215 is adapted to include a corresponding elongated notch (not shown). Like elongated notch 280, the notch of reciprocating member 215 is preferably located along the longest side of reciprocating member 215. The elongated notches of each reciprocating member are arranged to overlap each other when reciprocating members 220 and 215 are operably disposed within case 240.

Retaining means 270, in this case a small screw, is insertable through case 240 and through the slots of each reciprocating member 215 and 220 such that stopping edge 299, and the corresponding stopping edge of reciprocating member 215 are engaged by the retaining means when reciprocating members 215 and 220 are extended fully outwardly from case 240. In that manner reciprocating members 215 and 220 are limited in their outward travel and prevented from escaping case 240 during operation of cigar cutter 200. When it is desired to replace reciprocating members 215 and 220, retaining means 270 can be removed and reciprocating members 215 and 220 slidably separated from case 240. Replacement members for reciprocating members 215 and 220 can then be slidably inserted and retaining means 270 reinserted.

It is intended that the above description of preferred embodiments of the structure of the present invention and the description of its operation are but one or two enabling best mode embodiments for implementing the invention. Other modifications and variations are likely to be conceived of by those skilled in the art upon a reading of the preferred embodiments and a consideration of the appended claims and drawings. These modifications and variations still fall within the breadth and scope of the disclosure of the present invention.

I claim:

1. A device for cutting a cigar, the device comprising:

two opposing and cooperating reciprocating members adapted to move past one another, each reciprocating member including at its distal end a generally sickle shaped blade portion for cutting the end of the cigar, said blade portion having a radius of curvature that is non-constant;

a casing within which said generally sickle shaped blade portions are housed;

said opposing and cooperating reciprocating members being slidably mounted within said casing for movement relative to each other; and, wherein said generally sickle shaped blade portions cut the cigar in a transverse direction from one side of the cigar to the other, both blade members moving from the same side of the cigar at the same time.

2. A device for cutting a cigar, the device comprising:

two opposing and cooperating reciprocating members adapted to move past one another, each reciprocating member including at its distal end a generally sickle shaped blade portion for cutting the end of the cigar;

a casing within which said generally sickle shaped blade portions are housed;

said opposing and cooperating reciprocating members being slidably mounted within said casing for movement relative to each other and each of said opposing and cooperating reciprocating members including a blade carrying portion, each blade carrying portion having a recessed area defining an elongated notch alone a side of said blade carrying portion, said notch forming a stopping edge at the distal end of said blade carrying portion, said casing including an opening for removably inserting retaining means therethrough, such that said retaining means passes through each of said notches and engages both of said stopping edges when said opposing and cooperating members are extended fully outwardly from said casing.

3. The device of claim 1 wherein said opposing and cooperating reciprocating members are substantially identical to one another.

4. The device of claim 1 wherein said opposing and cooperating reciprocating members are placed in back to back configuration relative to one another within said casing.

5. The device of claim 1 wherein said generally sickle shaped blade portion is characterized by a gradually diminishing grind angle.

6. A device for cutting a cigar, the device comprising:

two opposing and cooperating reciprocating members adapted to move past one another, each reciprocating member including at its distal end a generally sickle shaped blade Portion for cutting the end of the cigar;

a casing within which said generally sickle shaped blade portions are housed;

said opposing and cooperating reciprocating members being slidably mounted within said casing for movement relative to each other, said opposing and cooperating reciprocating members include handle portions for inserting the thumb or finger of a hand therethrough.

7. The device of claim 6 wherein said handle portions are substantially circular in shape.

8. A cigar cutter comprising:

two opposing and cooperating reciprocating members adapted to move past one another and through a cigar tip;

each reciprocating member including at its distal end a generally sickle shaped blade portion having a radius of curvature that is non-constant, for cutting the cigar tip;

wherein said generally sickle shaped blade portions cut the cigar tip in a transverse direction from one side of the cigar tip to the other, both blade members moving from the same side of the cigar tip at the same time.

9. The cigar cutter of claim 8 further comprising a casing within which said opposing and cooperating reciprocating members are disposed for slidable motion relative to each other.

* * * * *

UNITED STATES PATENT AND TRADEMARK OFFICE

CERTIFICATE OF CORRECTION

PATENT NO. : 5,893,212

DATED : April 13, 1999

INVENTOR(S) : Ronald J. Meister

It is certified that error appears in the above-indentified patent and that said Letters Patent is hereby corrected as shown below:

Col. 6, line 38 - delete "alone" and insert --along--

Col. 6, line 60 - delete "Portion" and insert --portion--

Signed and Sealed this

Twenty-seventh Day of July, 1999

*Attest:*

Q. TODD DICKINSON

*Attesting Officer*

*Acting Commissioner of Patents and Trademarks*